US009873974B2

(12) United States Patent
Coniguardi et al.

(10) Patent No.: US 9,873,974 B2
(45) Date of Patent: Jan. 23, 2018

(54) MACHINE ADAPTED TO CARRY OUT AT LEAST ONE LAUNDRY DRYING CYCLE

(71) Applicant: Indesit Company S.p.A., Fabriano (IT)

(72) Inventors: Antonio Coniguardi, Fabriano (IT); Sandro Duri, Fabriano (IT)

(73) Assignee: Indesit Company S.p.A., Fabriano (IT)

( * ) Notice: Subject to any disclaimer, the term of this patent is extended or adjusted under 35 U.S.C. 154(b) by 263 days.

(21) Appl. No.: 14/443,085

(22) PCT Filed: Nov. 13, 2013

(86) PCT No.: PCT/IB2013/060096
§ 371 (c)(1),
(2) Date: May 15, 2015

(87) PCT Pub. No.: WO2014/091332
PCT Pub. Date: Jun. 19, 2014

(65) Prior Publication Data

US 2015/0292140 A1 Oct. 15, 2015

(30) Foreign Application Priority Data

Nov. 16, 2012 (IT) ..... TO2012A1001

(51) Int. Cl.
*D06F 58/02* (2006.01)
*D06F 58/04* (2006.01)
(Continued)

(52) U.S. Cl.
CPC ..... *D06F 58/02* (2013.01); *D06F 58/04* (2013.01); *D06F 58/18* (2013.01); *D06F 58/206* (2013.01); *D06F 58/22* (2013.01); *D06F 58/24* (2013.01)

(58) Field of Classification Search
CPC ..... D06F 58/18
See application file for complete search history.

(56) References Cited

U.S. PATENT DOCUMENTS 8,863,401 B2 * 10/2014 Grunert ..... D06F 58/22 210/791
9,249,538 B2 * 2/2016 Bison ..... D06F 58/24
(Continued)

FOREIGN PATENT DOCUMENTS

DE 19504034 A1 9/1995
DE 19828242 A1 12/1999
(Continued)

OTHER PUBLICATIONS

Translation of DE19828242, retrieved on Mar. 24, 2017.*
(Continued)

*Primary Examiner* — Nathaniel Wiehe
*Assistant Examiner* — Timothy J Teicher

(57) ABSTRACT

A machine adapted to carry out at least one laundry drying cycle. Such machine comprises a frame wherein a tub is mounted; a drum wherein laundry is placed, said drum being rotatably mounted within the tub and having at least one load opening; a door movable between a closed position and an open position; a drying system comprising: an intake channel for removing humid air from the tub; a delivery channel for supplying dry air into the drum; a drying apparatus interposed between the intake channel and the delivery channel for separating at least partially the air from the water contained therein obtaining dry air. The delivery channel is at least partially provided on the door.

19 Claims, 8 Drawing Sheets

(51) Int. Cl.

| | |
|---|---|
| ***D06F 58/18*** | (2006.01) |
| ***D06F 58/22*** | (2006.01) |
| ***D06F 58/24*** | (2006.01) |
| *D06F 58/20* | (2006.01) |

(56) References Cited

U.S. PATENT DOCUMENTS

| | | | | |
|---|---|---|---|---|
| 2005/0210698 | A1* | 9/2005 | Casey | D06F 58/206 34/134 |
| 2012/0096733 | A1* | 4/2012 | Sans Rovira | D06F 58/02 34/108 |

FOREIGN PATENT DOCUMENTS

| | | | |
|---|---|---|---|
| DE | 102010039552 | A1 | 2/2012 |
| EP | 1108812 | A1 | 6/2001 |
| EP | 2436830 | A1 | 4/2012 |

OTHER PUBLICATIONS

ISR International Patent Application No. PCT/IB2013060096, filed Nov. 13, 2013 dated Feb. 17, 2014, Applicant: Indesit Company SPA. International Publication No. WO2014091332A1, publication date: Jun. 19, 2014.
International Patent Application No. PCT/IB2013060096, filed Nov. 13, 2013, Applicant: Indesit Company SPA. International Publication No. WO2014091332A1, publication date: Jun. 19, 2014.

* cited by examiner

MACHINE ADAPTED TO CARRY OUT AT LEAST ONE LAUNDRY DRYING CYCLE

BACKGROUND OF THE DISCLOSURE

The present disclosure relates to a machine adapted to carry out at least one laundry drying cycle.

Such machine can be both a dryer and a washing machine provided with a drying feature (so called washer-dryer).

As it is known, at the end of a washing cycle it is necessary to dry the laundry that has been washed.

The drying can be carried out manually, by hanging the laundry out such that it can progressively disperse the amount of water it contains in the surrounding environment.

The drying can also be carried out automatically or semi-automatically within dryers or washing machines having the drying feature.

In some cases the machine is provided with a drying system which takes humid air from the tub within which the laundry to be dried is placed, it dries the humid air and it supplies again the same dried air into the tub.

Typically the process is carried out continuously, such that the air is removed from the tub and subjected to water separation in a substantially continuous manner.

The Applicant has found that the laundry drying process can be slowed down, if a garment is at the outlet of the drying circuit, that is where the dehumidified air is re-introduced into the tub. Such garment can interfere with the flow of dehumidified air towards the inside of the tub and, as mentioned, it can obstruct and slow down the drying action.

The Applicant has also found that, in the systems according to the prior art, the supply of dried/dehumidified air occurs at a peripheral portion of the tub: this prevents the laundry from being directly hit by the flow of dried air and from being subjected to a uniform and homogeneous drying process. Moreover in the prior art systems, the flow rate of the drying air is limited (about 60 cubic meters per hour).

SUMMARY OF THE PRESENT DISCLOSURE

The object of the present disclosure therefore is to provide a machine adapted to carry out at least one laundry drying cycle, while reducing the probability that a garment can interfere with the air flow used for drying and consequently that it can slow down the proper operation of the drying cycle.

A further object of the disclosure is to provide a machine adapted to carry out at least one laundry drying cycle, wherein the laundry is directly and substantially uniformly hit by the flow of dried/dehumidified air produced by the drying system, and that is able to guarantee a high drying air flow rate.

These and other further objects are substantially achieved by a machine adapted to carry out at least one drying cycle according to what described in the annexed claims.

An idea for the solution at the base of the present disclosure therefore provides the delivery channel of the drying circuit to be provided at least partially on the door closing the tub.

In more details, according to one aspect, the present disclosure relates to a machine adapted to carry out at least one laundry drying cycle, including a frame, a tub mounted in the frame, and a drum to place laundry. The drum is rotatably mounted within the tub and has at least one load opening allowing said laundry to be inserted and/or removed. Also included is a door movable between a closed position and an open position. There is a drying system with an intake channel for removing humid air from said drum, a delivery channel for supplying dry air into said drum, and a drying apparatus between the intake channel and the delivery channel for separating the air at least partially from the water, obtaining more dry air, that is with a smaller water concentration. The delivery channel is at least partially provided on said door.

The delivery channel comprises at least one first portion substantially integral with said frame and one second portion substantially integral with said door.

The first portion has one or more outlets and said second portion has one or more respective inlets, said first and second portions being so arranged that, when said door is in the closed condition, each outlet of said first portion faces a respective inlet of said second portion.

Thus when the door is in the closed position, the first and second portions of the delivery channel define at least one substantially continuous duct that can put the drying apparatus and the inside of the drum in fluidic communication, hitting the laundry in a direct and homogeneous manner.

The tub and said drum have a substantially cylindrical shape and are substantially coaxial; preferably said drum has a front base whereon said load opening is obtained and a rear base axially opposite to said front base, the rear base being provided with holes for allowing said rear base to be passed through by a flow of drying air. Behind such rear base of the drum, the tub has a rear wall upon which an aperture is obtained from which said intake channel extends in order to remove said humid air.

The delivery channel, when said door is in the closed condition, opens into the load opening of said drum.

The drying apparatus comprises a heat pump circuit.

Thus it is possible to optimize the energy efficiency of the drying process.

The frame comprises a base, located at the bottom within said frame, wherein the drying system and in particular said drying apparatus is housed at least partially.

Thus it is possible to simplify the structure of the machine, as well as the steps for mounting and assembling it.

The drying system further comprises a filter for filtering said air, which is arranged upstream of said drying apparatus.

Thus it is possible to prevent amounts of fluff from accumulating in the drying apparatus which are able to compromise the correct operation of the apparatus itself.

Preferably said filter is a self-cleaning filter.

Thus a suitable cleaning and a consequent operation of the filter are guaranteed, although it is placed in such a manner to be substantially inaccessible unless carrying out complex operations for disassembling at least partially the machine.

The second portion of the delivery channel includes an end aperture for delivering said dried air into said drum, a first section extending from said end aperture and directed substantially upwards, and a second section adjacent to said first section and directed downwards for connecting to said one or more inlets.

Thus, in the case of a washer-dryer, the overflowing of water and/or water mixed with cleaning agent into the drying circuit is minimized when operating as washing machine.

The first portion of said delivery channel has a plurality of ducts, each having a first end adapted to receive dried air and a second end afferent to a respective outlet, wherein the second portion of said delivery channel comprises a plurality of ducts, each associated with a respective one of the ducts of said first portion, each duct of said second portion having a first end afferent to a respective inlet, and a second end in fluidic communication with an end aperture of said second portion.

Thus it is possible to divide the air flow into different ducts, and to obtain the desired flow without causing excessive structural weakening in the frame of the machine.

The machine according to the disclosure further comprises a storage tank connected to said drying apparatus through a drain circuit to collect the condensed water obtained from said humid air. Thus it is possible to store the water removed from the laundry during the drying operation and to re-use it later, for example for a following washing step in the case of a dryer and/or for allowing the self-cleaning filter to perform self-cleaning operations.

The machine according to the disclosure comprises means for promoting a first flow of said collected water from said tank to said tub in order to recycle said collected water for wash/rinse operations.

The machine according to the disclosure comprises means for promoting a second flow of said collected water from said tank to said filter in order to recycle said collected water for self-cleaning operations of said filter.

The machine according to the disclosure further comprises a switch which can be driven into at least two different configurations in order to selectively enable said first flow or said second flow.

Thus it is possible to select in a proactive manner which has to be the intended use of the water collected in the storage tank.

BRIEF DESCRIPTION OF THE DRAWINGS

Some preferred and advantageous embodiments are described by way of example and not as a limitation, with reference to the annexed figures, wherein.

The figures show different aspects and embodiments of the present disclosure, and, where appropriate, like structures, components, materials and/or elements in different figures are denoted by like reference numerals.

DETAILED DESCRIPTION OF EMBODIMENTS

Figure 1:
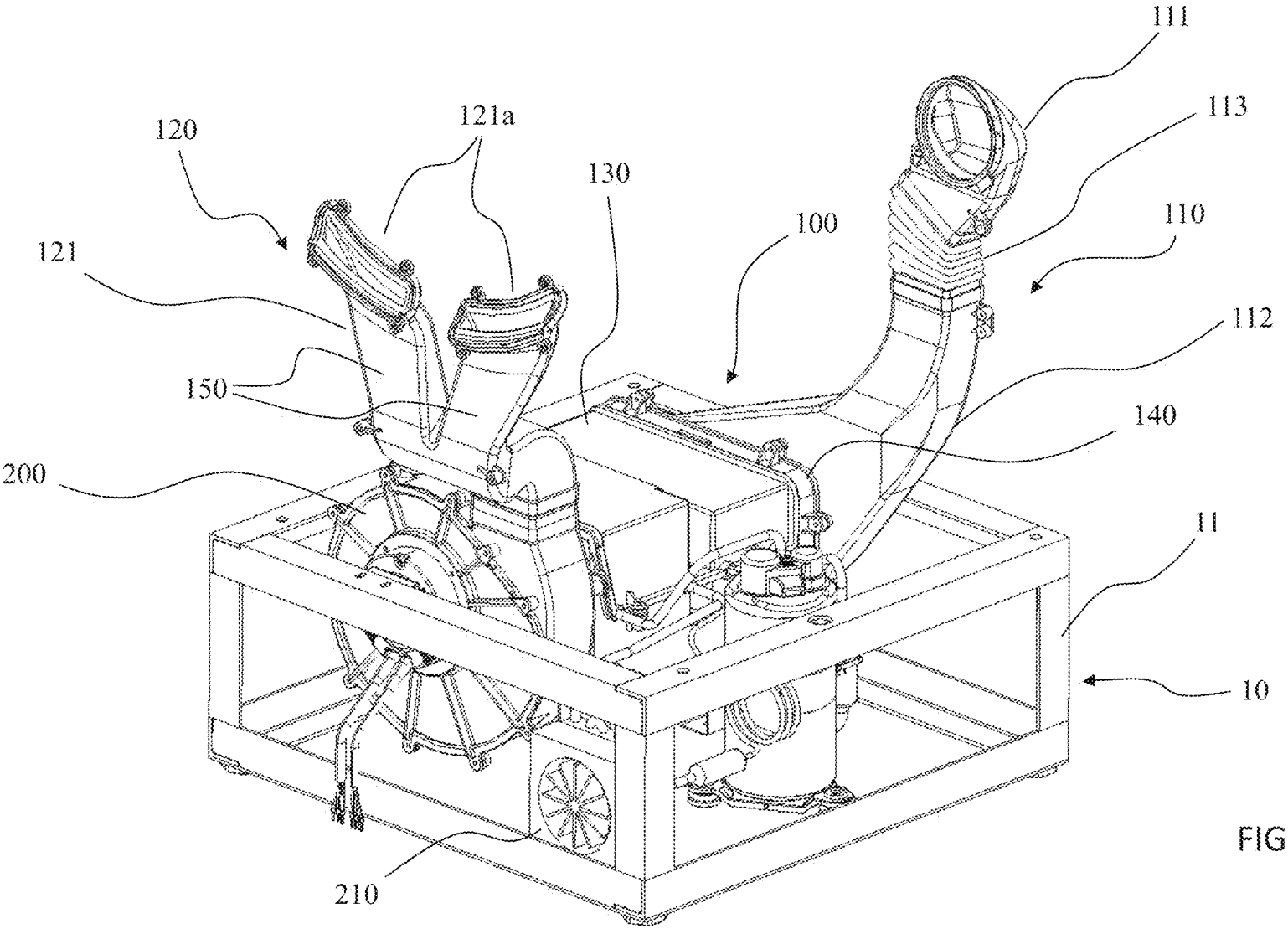
FIG. 1 is a schematic perspective view of a machine according to the present disclosure, wherein some parts have been omitted for better pointing out other parts.
Figure 2:
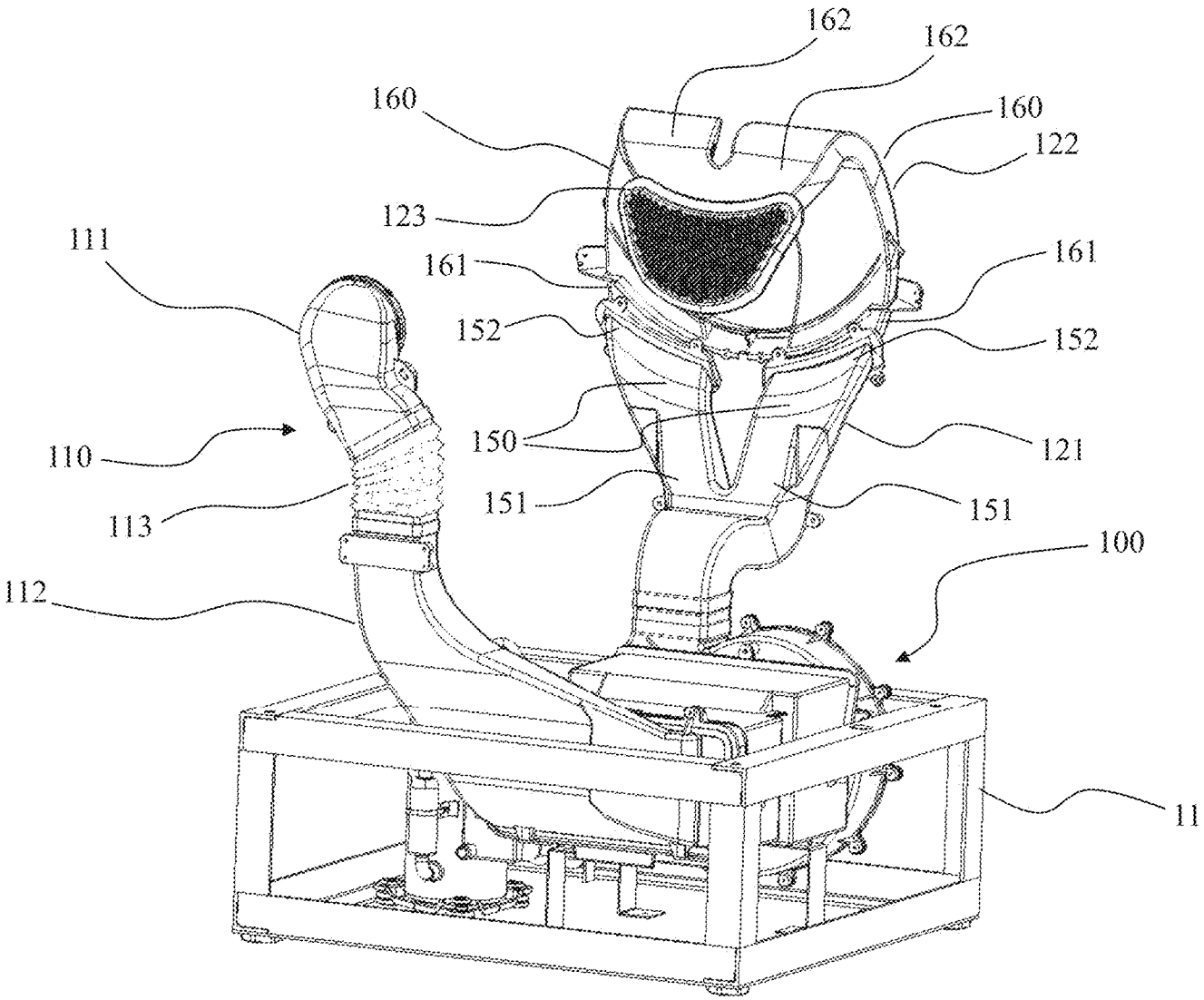
FIG. 2 is the machine of FIG. 1 in a perspective view taken from a different angle.

With reference to the annexed figures, 1 generally denotes a machine adapted to carry out at least one drying cycle according to the present disclosure.

The machine 1 can be a dryer. The machine 1 can also be a washing machine provided with the drying feature (so called washer-dryer).

The machine 1 (FIGS. 1-8) firstly comprises a frame 10, preferably made of metal material, arranged for supporting and/or housing the several parts the machine 1 is composed of.

The frame 10 for example may have a substantially parallelepiped shape.

The machine 1 further comprises a tub 20, mounted on said frame 10.

Inside the tub 20 a drum 25 is rotatably mounted, wherein laundry to be dried is placed. In the case the machine 1 is a washer-dryer, the drum 25 advantageously can be the same drum wherein laundry undergoes washing operations.

Preferably the drum 25 has a load opening 21, allowing laundry to be placed within the drum 25 and/or said laundry to be removed from the drum 25.

Preferably the drum 25 has one or more through holes for a fluidic communication between the inside of the drum 25 and the tub 20.

In the case of a washer-dryer, said one or more through holes allow the wash/rinse fluids to reach the inside of the drum 25 and to be discharged therefrom.

Figure 5:
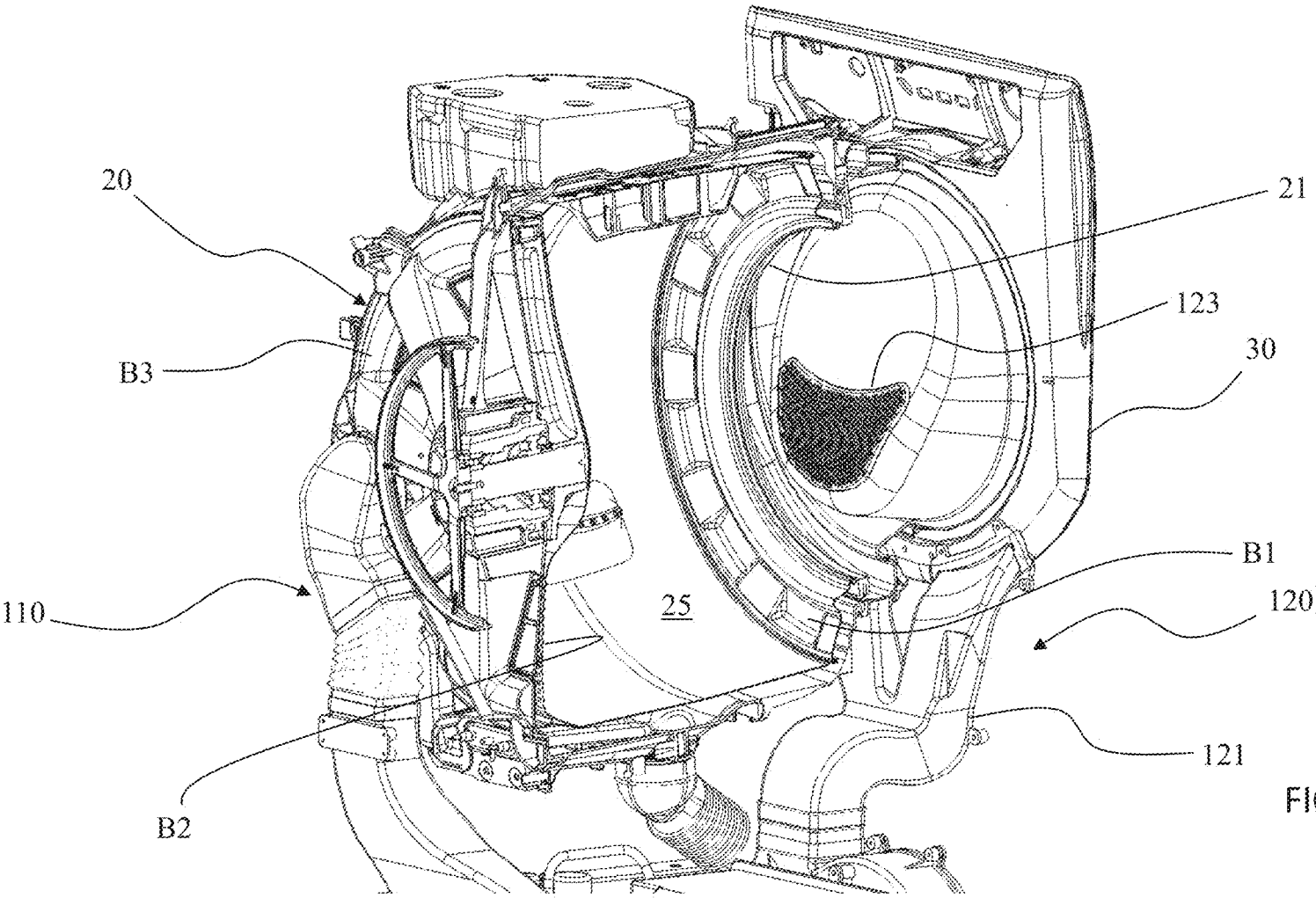
FIG. 5 is a schematic perspective view of a machine according to the present disclosure, wherein some parts have been sectioned and other omitted for better pointing out other parts.
Figure 6:
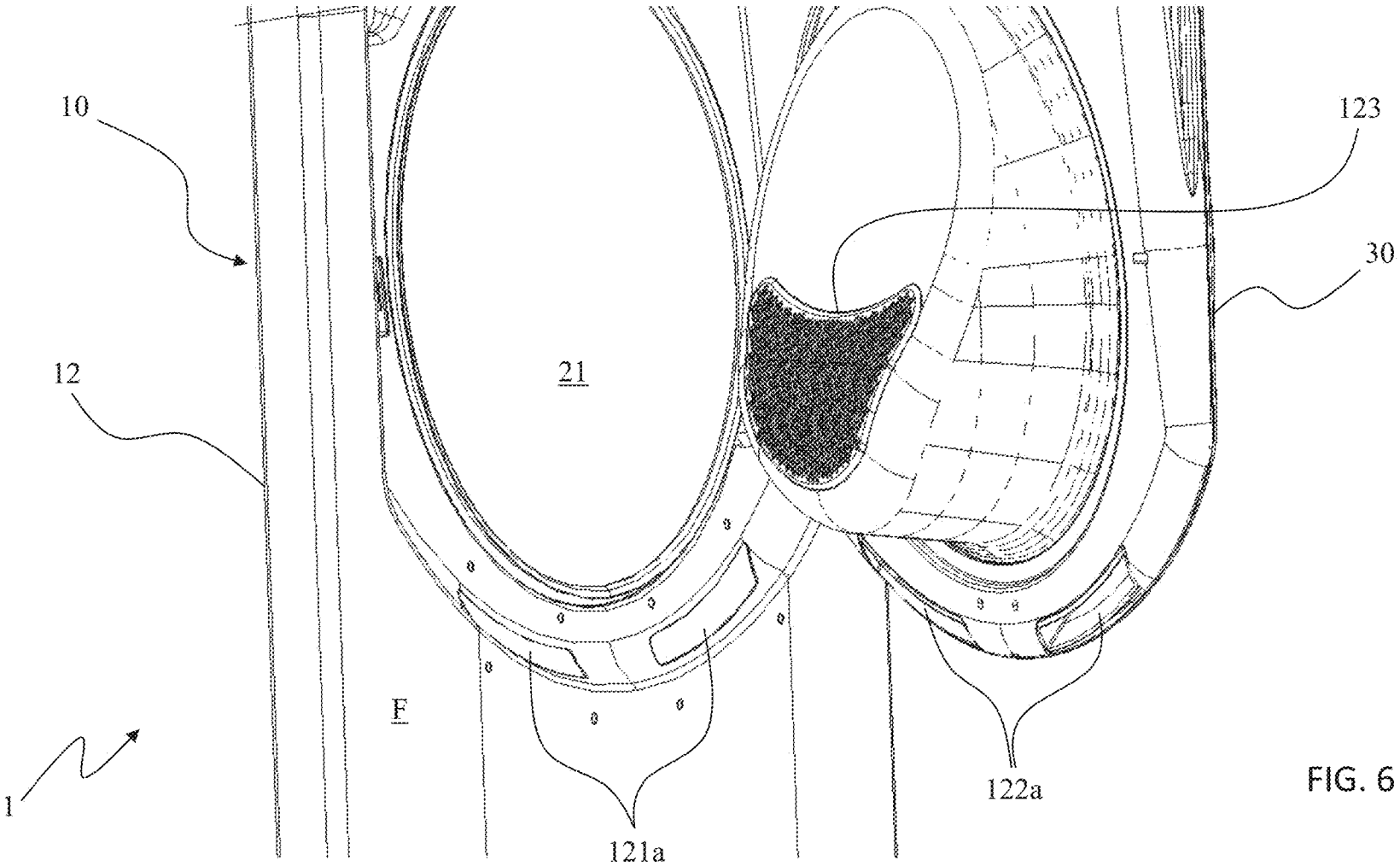
FIG. 6 is a schematic perspective view of a detail of the machine according to the disclosure.

Preferably the tub 20 and the drum 25 have a substantially cylindrical shape, as schematically shown in FIG. 5.

Preferably the tub 20 and the drum 25 are substantially coaxial, and the drum 25 extends into a radially internal region of the tub 20.

Preferably the drum 25 has a front base B1 wherein the load opening 21 is obtained and a rear base B2 axially opposite to said front base B1, the rear base B2 being equipped with holes for allowing a drying air flow to pass through said rear base.

Preferably the tub 20 has a rear wall B3 located behind the rear base B2 of the drum 25. On such rear wall B3 an aperture is obtained from which the intake channel 110 extends in order to remove said humid air from the inside of the drum 25 by using, for such air passage, the holes Y obtained on the rear base B2 of the drum 25.

Preferably the holes Y are located at a distance from a centre of the rear base B2 which is substantially equal to a distance between a centre of the rear wall B3 and the aperture of the same rear wall B3 from which the intake channel 110 extends.

Thus the through holes Y substantially face the aperture 109 from which the intake channel 110 extends and they allow the efficiency of the humid air removal operation to be maximized.

Figure 8:
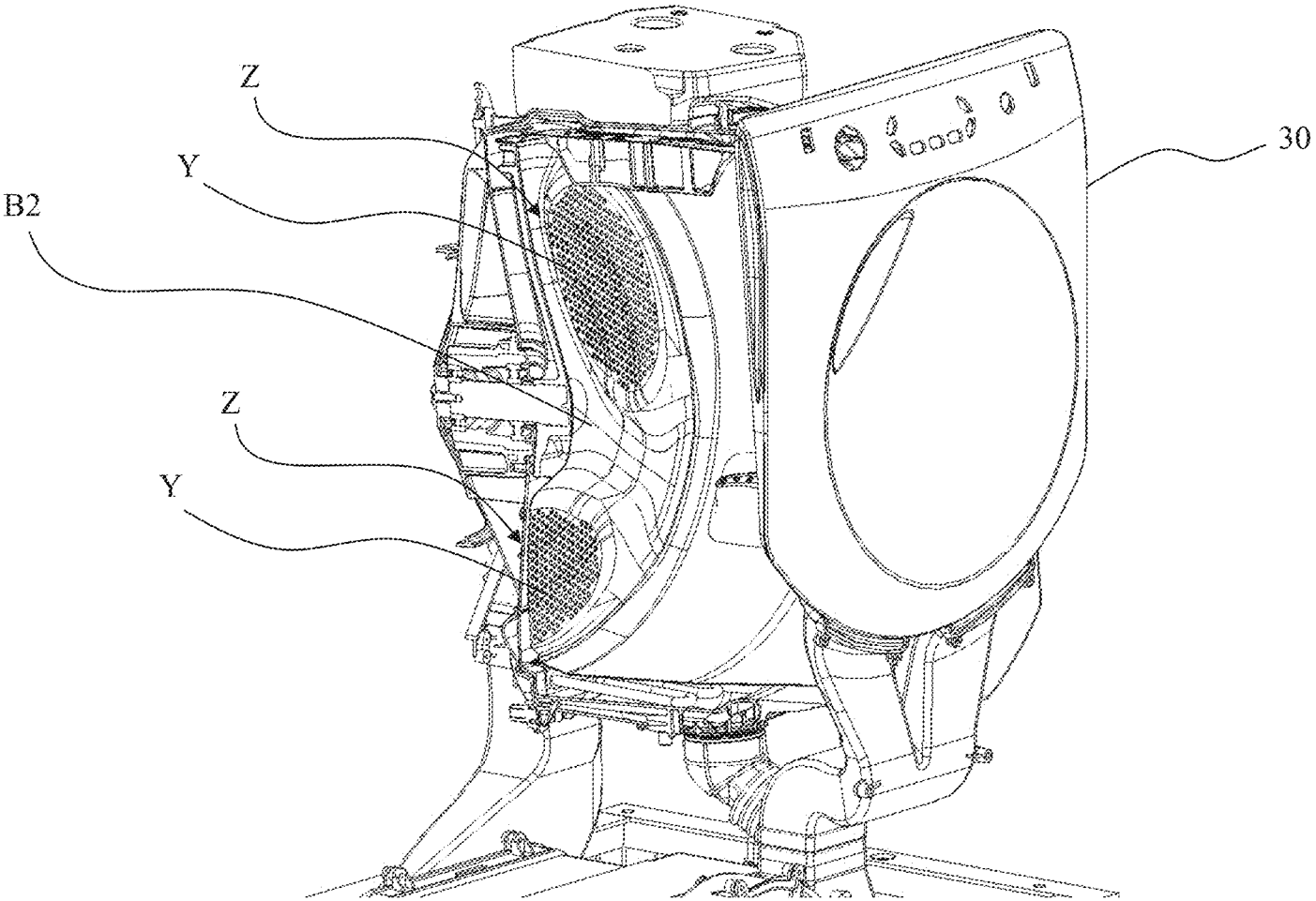
FIG. 8 schematically is some details of the machine according to the disclosure.

Particularly, as schematically shown in FIG. 8, the through holes Y can be divided into a plurality of areas Z which are angularly equidistant from a centre of said rear base B2.

As an example three areas Z can be provided, spaced from each other by 120°.

The machine 1 further comprises a door 30, operatively associated to the drum 25.

The door 30 is movable between a closed position wherein it closes the load opening 21 of the drum 25, and an open position wherein the load opening 21 of the drum 25 stays partially or completely open.

Preferably the door 30 is hinged to the frame 10, and particularly to a front wall F thereof.

The door 30 can comprise a transparent porthole, which allows the user to see the internal portion of the drum 25 and the laundry placed therein. In several embodiments, the door 30 is completely opaque and it does not permit to see through.

The machine 1 further comprises a drying system 100 operatively associated to the tub 20 and to the drum 25 for drying the laundry placed inside the drum 25.

The drying system 100 comprises an intake channel 110 arranged for removing humid air from the drum 25.

Preferably as schematically shown in FIG. 5, the intake channel 110 extends from the above mentioned rear wall B3 of the tub 20 for removing humid air.

In practice the intake channel 110 can be composed of one or more ducts, mutually associated in a suitable manner, such to allow humid air to be removed from the drum 25 and from the tub 20.

In more details, in the preferred embodiment, the intake channel 110 is composed of:

- a connector 111 afferent to the inside of the tub 20;
- a monobloc element 112, preferably made of plastic material, for a connection with the filter 140 (which will be better described below);
- a bellows 113, preferably made of elastomeric material and connected downstream of the connector 111 and upstream of the monobloc element 112; the bellows 113 aims at allowing the connector 111 and the monobloc element 112 to be connected although leaving a specific freedom of movement to the tub 20 and to the connector 111 integral thereto.

Therefore by means of the intake channel 110 humid air originally provided inside the drum 25 and propagating inside the tub 20 through the holes of the drum 25 described above is removed.

Preferably, by considering a reference system wherein the machine 1 is arranged such to operate under standard conditions, the intake channel 110 is substantially directed downwards, such to connect with the other elements being part of the drying system 100.

The drying system 100 is preferably arranged at least partially under the tub 20. In more details, such as shown in FIGS. 1-4, the drying system 100 is housed at least partially in a base 11 that is part of the frame 10.

The base 11, particularly, is located in the lower part of the frame 10, that is in the part at the bottom of the frame 10.

In one embodiment the frame 10 is composed of the combination of the cabinet 12 housing a standard washing machine and of the base 11 which are mechanically connected to one another. From a practical point of view, the base 11 is provided, inside which at least some parts of the drying system 100 are mounted; then the real machine is placed on the base 11. Once the appropriate connections are made, mainly of the hydraulic type, among the devices placed in the base 11 and those included in the remaining part of the machine, the latter can be considered to be completely assembled and ready for being used.

In one embodiment the base 11 can be made as a monobloc element made of plastic material, suitably shaped for housing one or more elements of the drying system 100.

The drying system 100 further comprises a delivery channel 120 allowing air at least partially dried/dehumidified to be supplied again into the drum 25.

The delivery channel 120 will be described in more details below.

The drying system 100 further comprises a drying apparatus 130 operatively interposed between the intake channel 110 and the delivery channel 120.

The drying apparatus 130 provides to remove at least a part of the water present in the humid air taken by the intake channel 110, such to supply in the drum 25 less humid air through the delivery channel 120.

Preferably the drying apparatus 130 can comprise a condensing device 131, with the aim of condensing the present water at a gaseous state in the humid air taken from the tub 20.

Such condensing device 131 can be an evaporator of a suitable thermodynamic circuit.

As an example, the condensing device 131 can be a part of a heat pump circuit.

Advantageously the heat pump circuit further comprises a heat exchanger 132, by means of which the air previously dehumidified by the condensing device 131 can be heated, such to increase its own efficacy when it is again supplied into the drum 25.

In practice, the drying apparatus 130 can be composed of the condenser of the mentioned heat pump circuit.

Humid air taken from the tub 20 therefore is firstly subjected to the action of the condensing device 131, and then to the action of the heat exchanger 132. Thus dried and heated air is supplied into the drum 25, such to further promote the drying of the laundry.

Preferably the condensing device 131 and the heat exchanger 132 are suitably combined with a compressor and a throttling valve of the heat pump circuit.

In a different embodiment, the drying apparatus 130 can have a different structure, for example comprising a conventional condenser (that is continuously hit by a cold air flow, such to condense the steam) and/or a heating element of the resistive type.

Preferably the machine 1 can comprise an auxiliary fan 210 (FIG. 1), intended to flow air from the outside of the machine to the inside of the machine with the aim of cooling the several components of the heat pump circuit.

Preferably the drying apparatus 130 is located in said base 11.

As mentioned above, the drying system 100 comprises a delivery channel 120 for supplying in the drum 25 the air previously subjected to the dehumidification process by the drying apparatus 130.

According to the disclosure, the delivery channel is at least partially arranged on the door 30.

More particularly, the delivery channel 120 comprises a first portion 121 and a second portion 122.

The first portion 121 is substantially integral with the frame 10. In a preferred embodiment, the first portion 121 extends from the drying apparatus 130, or from a fan 200 arranged downstream thereof, up to the inner surface of the front wall F of the frame 10, namely the wall to which the door 30 can be hinged.

Advantageously the first portion 121 of the delivery channel 120 has one or more outlets 121*a*, such to allow the dehumidified air flowing inside such first portion 121 to reach the second portion 122.

Preferably the front wall F is provided with one or more slots, each one corresponding to a respective one of said one or more outlets 121*a*.

The second portion 122 of the delivery channel 120 is substantially integral with the door 30.

Advantageously the second portion 122 of the delivery channel 120 has one or more inlets 122*a*, each one operatively associated to a respective one of said outlets 122*a* of the first portion 121.

Particularly the first and second portions 121, 122 are shaped and arranged such that when the door 30 is in the closed condition, each outlet 121*a* of the first portion 121 faces a respective inlet 122*a* of the second portion 122.

Preferably when the door 30 is in the closed condition, the delivery channel 120 opens into the load opening 21 of the drum 25.

Thus, when the door 30 is in the closed position, the first and second portions 121, 122 of the delivery channel 120 define a substantially continuous path and allow the dehumidified air coming from the drying apparatus 130 to reach the inside of the drum 25.

The outlets 121*a* and the inlets 122*a* are shaped such that, when the door 30 is in the closed position, the dehumidified air from the drying apparatus 130 can flow from the first to the second portion 121, 122 of the delivery channel 120 without any substantial leakages.

Advantageously at the coupling area between the outlets 121*a* and inlets 122*a* there are provided suitable fluid-tight gaskets (not shown), such to further reduce the risk of said leakages.

In one embodiment, the first portion of the delivery channel 120 comprises a plurality of ducts 150, each one having a first end 151 adapted to receive air dried/dehumidified by the drying apparatus 130, and a second end 152 afferent to a respective outlet 121*a*.

Preferably the second portion 122 of the delivery channel 120 comprises a plurality of ducts 160, each associated with a respective one of the ducts 150 of the first portion 121.

Particularly each duct 160 of the second portion 122 has a first end 161 afferent to a respective inlet 121*a*, and a second end 162 in fluidic communication with an end aperture 123 of the second portion 122.

In the embodiment shown in FIGS. 1-6, the first portion 121 of the delivery channel 120 comprises two ducts 150 and the second portion 122 of the delivery channel 120 comprises two ducts 160.

Figure 7:
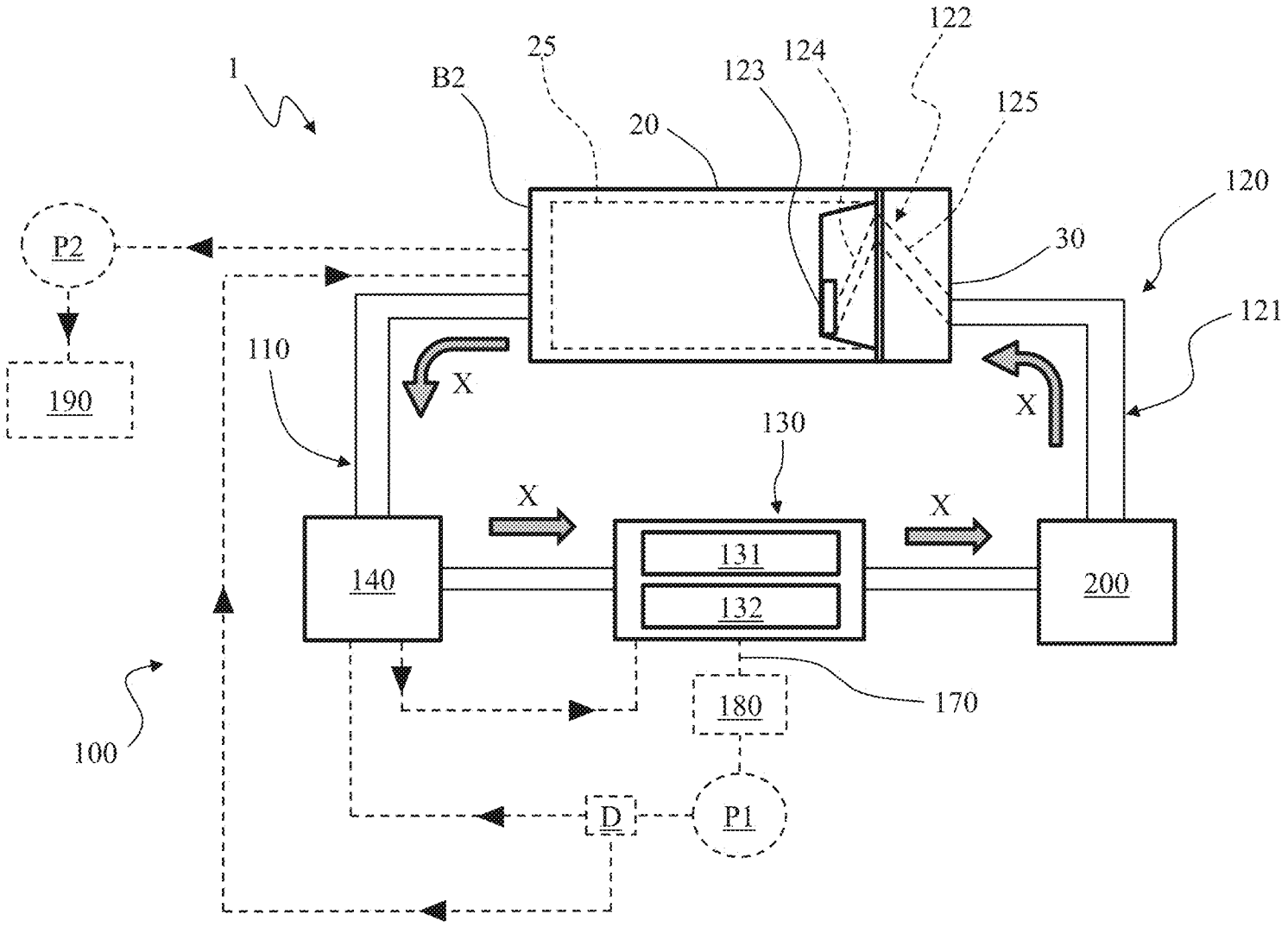
FIG. 7 is a block diagram showing some parts of the machine according to the disclosure.

In one embodiment, the second portion 122 of the delivery channel 120 comprises (following the structure of the second portion 122 in a direction opposite to the propagation direction of the air in the drying system 100 denoted by arrows X in FIG. 7): an end aperture 123 for delivering the dried air into the drum 25, particularly when the door 30 is in the closed position; a first section 124 extending from the end aperture 123 and directed substantially upwards away from the end aperture 123; a second section 125 adjacent to said first section 124 and directed downwards away from the first section 124 for connecting to the inlets 122*a*.

Figure 3:
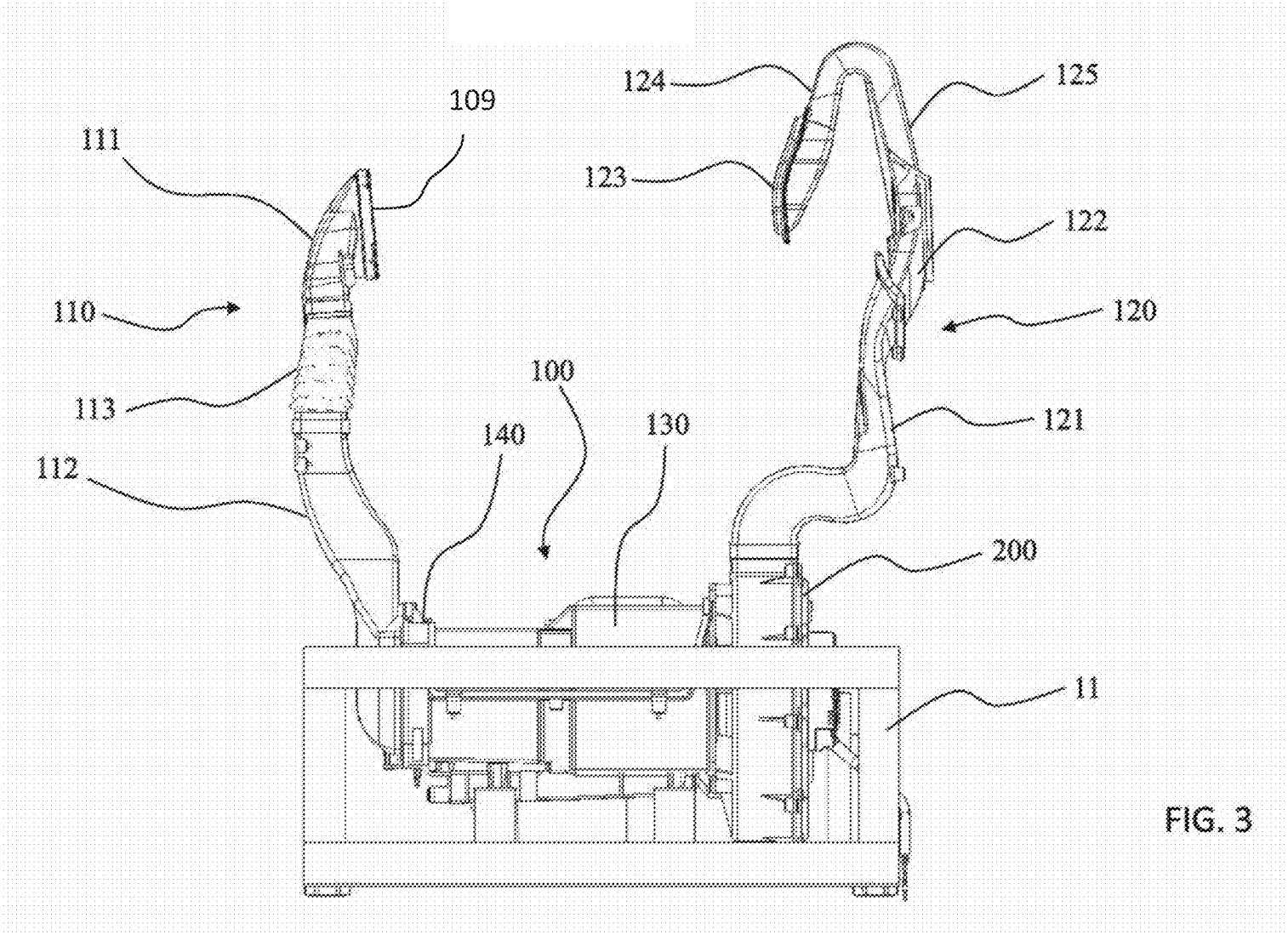
FIG. 3 is a side view of the machine of FIGS. 1 and 2.
Figure 4:
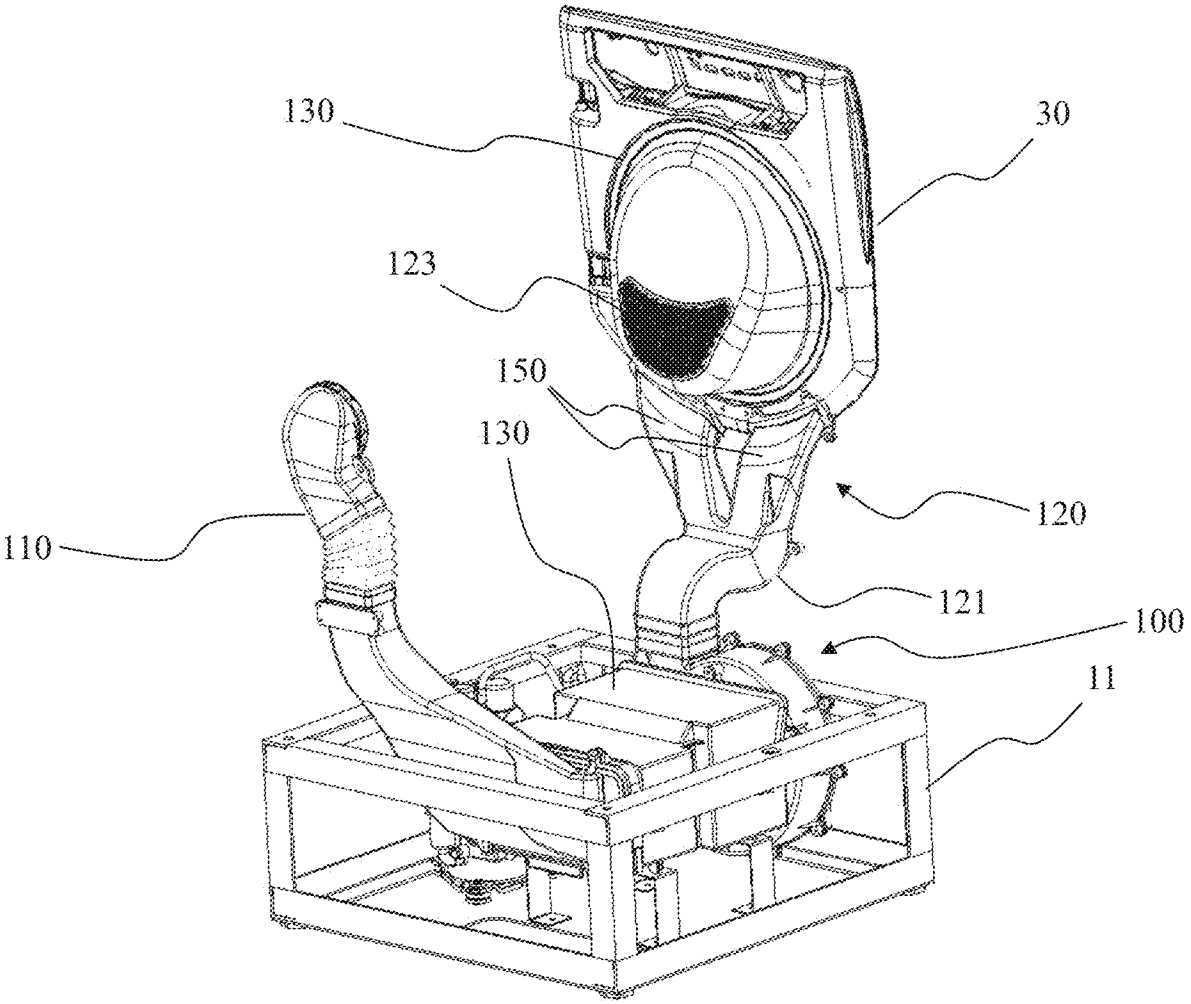
FIG. 4 is a perspective view like that of FIG. 1, wherein a door of the machine according to the disclosure is also shown.

In practice, the second portion 122 of the delivery channel 120 may have in the side view, as shown as an example in FIGS. 3 and 7, a "gooseneck" shape, able to limit/avoid possible flows of fluid inside the drying system 100 during the washing cycles.

Suitably, at the end aperture 123 an intrusion-preventing grid can be mounted (schematized in FIGS. 2, 4-6) aiming at preventing one or more clothes from being moved towards the inside of the drying system 100.

Preferably the first portion 121 of the delivery channel 120 is made as a single monobloc element, comprising the several parts described above. Such monobloc element, in the preferred embodiment, is made of plastic material.

Preferably the second portion 122 of the delivery channel 120 is made as a single monobloc element, comprising the several parts described above. Such monobloc element, in the preferred embodiment, is made of plastic material.

Advantageously the drying system 100 further comprises a filter 140 for filtering the air flowing in the system 100.

In the preferred embodiment, the filter 140 is placed upstream of the drying apparatus 130, and preferably interposed between the drying apparatus 130 and the intake channel 110.

As schematically shown in FIGS. 1 and 3, the filter 140 can be housed into the base 11 of the frame 10.

Preferably the filter 140 is a self-cleaning filter. Thus it is possible to guarantee optimal performances of the filter 140 even if it is placed in a substantially inaccessible position for a user and therefore it cannot be easily subjected to periodical maintenance/cleaning.

The self-cleaning filter is able to autonomously/automatically remove (for example by water flows, mechanical stirring, etc.) fluff and other possible elements that typically get accumulated at the filter 140 and that progressively prevent it from efficaciously operating.

Preferably the machine 1 further comprises a drain circuit 170 connected to the drying apparatus 130 for draining the water removed from humid air coming from the tub.

In one embodiment the drain circuit 170 allows the water to be collected into a storage tank 180, that is a part of the machine 1; thus the water collected can be used for following washing operations, in the case of a washer-dryer, thus reducing the consumptions of the machine 1, and/or for cleaning the filter 140. Preferably the tank 180 is positioned at a lower level than the drying apparatus 130, such that the water condensed in the drying apparatus 130 can reach the tank 180 only by gravity, without the help of a dedicated pump.

Particularly, the tank 180 can be operatively associated to means for promoting a first water flow towards the tub 20 such to use again the water for following wash/rinse operations.

Advantageously the tank 180 has such a capacity allowing removed condensed water to be contained for more than one drying cycle.

Moreover the tank 180 can be provided with a pressure switch able to signal a condition of reached maximum level, after which further condensed water sent to the tank 180 is then sent to the tub 20 for being discharged.

The tank 180 can also be associated to means for promoting a second flow of collected water towards the filter 140, such to allow it to perform suitable self-cleaning operations by using such water.

Advantageously the self-cleaning operations are performed at the end of each drying cycle.

More in details, the machine 1 preferably comprises a first pump P1 promoting a flow of collected water towards a switch D.

A first outlet of the switch D directs the water towards the tub 20, such that the water can be used for laundry wash/rinse operations (in the case the machine 1 is a washer-dryer).

By means of a second pump P2 the recycled water may be sent to a drain circuit 190 of the machine 1 in order to be eliminated.

A second outlet of the switch D on the contrary directs the water towards the filter 140, such that it can perform a self-cleaning operation.

The water collected after this operation can be sent again to the drying apparatus 130 and, from it, it can return back to the storage tank 180.

Depending on the operating condition in which it is driven, the switch D can therefore promote the first water flow or the second water flow.

In a variant embodiment, the filter 140 can be directly connected to the drying apparatus 130 and use, for self-cleaning operations, the condensed water removed by the drying apparatus 130, without the need of using a storage tank.

As schematically shown in FIGS. 1, 3 and 7 the drying system 100 can comprise a fan 200 for promoting the air flow inside the system 100, particularly from the intake channel 110 towards the delivery channel 120.

In one embodiment the fan 200 is placed upstream of the drying apparatus 130, and particularly it is interposed between the drying apparatus 130 and the delivery channel 120.

The disclosure achieves important advantages.

Firstly, due to the particular structure of the drying system it maximizes the probability for the flow of dehumidified air towards the inside of the drum not to be limited by the laundry present in the drum.

Another advantage rises from the fact that, by the present disclosure, the dehumidified air is supplied in the drum such that the laundry contained therein can be directly hit by such flow and therefore the drying action can be performed in a substantially uniform manner, improving the quality of the operation of the machine and the results provided to the user.

Moreover the drying air flow rate is considerably higher than prior art systems, the machine according to the present disclosure being able to reach a drying air flow rate about of 180 cubic meters per hour.

Moreover, due to the "gooseneck" shape of the second portion of the delivery channel the fluids used in the tub during the washing steps are prevented from going back along the delivery channel, causing damages or malfunctions of the drying system.

A further advantage is found if considering the division of the delivery channel into two or more ducts substantially operating in parallel: thus it is possible to obtain an overall section for the air passage equal to a desired section, without inappropriately weakening the structure of the machine frame.

Finally, according to an advantageous variant of the present disclosure, if the machine is intended also for carrying out a clothes washing cycle, the heat pump circuit that is part of the drying apparatus can be used also for heating the water useful for carrying out such washing cycle.

It has to be noted that the functional diagram of FIG. 7 can identify inventive concepts wider and/or different, and therefore unrelated, with respect to what described with reference to the fact of arranging at least partially the delivery channel in the machine door.

This is particularly but not exclusively valid as regards the handling of the condensed water flow collected by the drying apparatus. Such handling can be applied also to machines wherein the delivery channel is not necessarily at least partially housed into the machine door.

The invention claimed is:

1. A machine adapted to carry out at least one laundry drying cycle, comprising:

a frame wherein a tub is mounted;

a drum wherein laundry is placed, the drum being rotatably mounted within the tub, having a drum axis of rotation, and having a load opening allowing laundry to be inserted and/or removed;

a door movable between a closed position, wherein the door closes the load opening, and an open position, wherein the load opening stays open; and a drying system comprising:

an intake channel for removing relatively humid air from the drum;

a delivery channel for supplying relatively dry air into the drum; and a drying apparatus interposed between the intake channel and the delivery channel for separating at least partially the relatively humid air from water contained therein, thereby obtaining the relatively dry air;

the delivery channel comprising a first portion and a second portion;

the first portion having at least one first portion duct at least partially integral with the frame, the at least one first portion duct having:

a first portion inlet end adapted to receive the relatively dry air from the drying apparatus; and a first portion outlet end afferent to a first portion outlet on an outer surface of the frame; and the first portion outlet positioned on a lower half of the frame;

the second portion having at least one second portion duct at least partially integral with the door, the at least one second portion duct having:

a second portion inlet end afferent to a second portion inlet positioned on a lower half of the door;

the second portion inlet adapted to receive the relatively dry air from the first portion outlet when the door is in the closed position; and a second portion outlet end adapted to exhaust the relatively dry air into the drum when the door is in the closed position;

wherein the second portion inlet is spaced apart from the first portion outlet when the door is in the open position.

2. The machine of claim 1, wherein:

the first portion outlet is one of at least two first portion outlets on the outer surface of the frame and positioned in the lower half of the frame; and the second portion inlet is one of at least two respective second portion inlets positioned on the lower half of the door;

the first portion outlets and the second portion inlets being so arranged that, when the door is in the closed position, each of the first portion outlets faces a respective second portion inlet; and when the door is in the open position, each of the first portion outlets are separated from the respective second portion inlet.

3. The machine of claim 1, wherein, when the door is in the closed position, the delivery channel opens into the load opening of the drum.

4. The machine of claim 1, wherein the frame comprises a base at a bottom of the frame, the drying system being housed at least partially in the base.

5. The machine of claim 1, wherein the second portion of the delivery channel comprises:

the second portion outlet end for delivering the relatively dry air into the drum;

a first section extending from the second portion outlet end and directed upwards with respect to the direction of gravity; and a second section adjacent to the first section and directed downwards with respect to the direction of gravity for connecting to the second portion inlet positioned on the lower half of the door.

6. The machine of claim 1, wherein:

the first portion of the delivery channel comprises a plurality of first portion ducts, each first portion duct having a first portion inlet end adapted to receive the relatively dry air from the drying apparatus and a first portion outlet end afferent to a respective first portion duct outlet;

the second portion of the delivery channel comprises a plurality of second portion ducts, each second portion duct associated with a respective first portion duct; and each second portion duct having a second portion inlet end afferent to a respective second portion inlet, and a second portion outlet end in fluidic communication with a second portion end aperture.

7. The machine of claim 1, wherein the drying apparatus is capable of heating water for an execution of a wash cycle.

8. The machine of claim 1, further comprising a storage tank connected to the drying apparatus through a drain circuit to collect the water obtained from the relatively humid air.

9. The machine of claim 8, wherein the storage tank is positioned at a lower level than the drying apparatus.

10. The machine of claim 1, wherein the drying system further comprises a filter for filtering the relatively humid air, which is arranged upstream of the drying apparatus.

11. The machine of claim 10, wherein the filter is a self-cleaning filter.

12. The machine of claim 10, wherein the filter is operationally connected to the drying apparatus in order to use condensed water coming from the drying apparatus to carry out a self-cleaning operation.

13. The machine of claim 1, wherein the tub and the drum have a cylindrical shape and are coaxial, wherein the drum has a front base proximate the load opening and a rear base axially opposite to the front base, wherein the tub has a rear wall located behind the rear base, wherein an intake channel inlet aperture is proximate the rear wall from which the intake channel extends in order to remove the relatively humid air.

14. The machine of claim 13, wherein the rear base of the drum has a plurality of through holes located at a radial distance from the drum axis of rotation such that a portion of the plurality of through holes are aligned with a portion of the intake channel inlet aperture during a portion of a rotation of the drum about the drum axis of rotation.

15. The machine of claim 14, wherein the through holes are divided into a plurality of areas on the rear base which are angularly equidistant from the drum axis of rotation.

16. A machine adapted to carry out a laundry drying cycle, comprising:

a frame wherein a tub is mounted;

a drum wherein laundry is placed, the drum being rotatably mounted within the tub and having a load opening allowing the laundry to be inserted and/or removed;

a door movable between a closed position, wherein the door closes the load opening, and an open position, wherein the load opening stays open; and a drying system comprising:

an intake channel for removing relatively humid air from the drum;

a delivery channel for supplying relatively dry air into the drum; and a drying apparatus interposed between the intake channel and the delivery channel for separating at least partially the relatively humid air from water contained therein, thereby obtaining the relatively dry air;

the delivery channel comprising:

a first portion which is at least partially integral with the frame, the first portion comprising a first portion inlet adapted to receive relatively dry air from the drying apparatus and a first portion outlet adapted to exhaust the relatively dry air, the first portion outlet positioned on an outer surface of a lower half of the frame; and a second portion which is at least partially integral with the door, the second portion comprising:

a second portion end aperture for delivering the relatively dry air into the drum;

a second portion outlet section extending from the second portion end aperture and directed upwards with respect to the direction of gravity;

a second portion inlet section connected to the second portion outlet section and directed downwards with respect to the direction of gravity for connecting to a second portion inlet; and the second portion inlet positioned on a lower half of the door;

wherein relatively dry air exhausted by the first portion outlet passes through the second portion inlet, into the second portion inlet section, travels upwards with respect to the direction of gravity through the second portion inlet section and into the second portion outlet section, travels downward with respect of the direction of gravity through the second portion outlet section, and is exhausted through the second portion end aperture into the drum when the door is in the closed position; and the second portion inlet being spaced apart from the first portion outlet when the door is in the open position.

17. The machine of claim 16, wherein the drying system further comprises a filter for filtering air, which is arranged upstream of the drying apparatus.

18. The machine of claim 17, wherein the filter is a self-cleaning filter.

19. A machine adapted to carry out at least one laundry drying cycle, comprising:

a frame wherein a tub is mounted;

a drum wherein laundry is placed, the drum being rotatably mounted within the tub and having a load opening allowing the laundry to be inserted and/or removed;

a door movable between a closed position, wherein the door closes the load opening, and an open position, wherein the load opening stays open; and a drying system comprising:

an intake channel for removing relatively humid air from the drum;

a delivery channel for supplying relatively dry air into the drum;

a drying apparatus interposed between the intake channel and the delivery channel for separating at least partially the relatively humid air from water contained therein, thereby obtaining the relatively dry air;

the delivery channel at least partially provided on the door and comprising at least one first portion which is at least partially integral with the frame and at least one second portion which is at least partially integral with the door;

the at least one first portion of the delivery channel comprising a plurality of first portion ducts, each first portion duct having a first portion intake end adapted to receive the relatively dry air from the drying apparatus and a first portion outlet end afferent to a respective first portion outlet positioned on an outer surface of the frame and in a lower half of the frame;

the at least one second portion of the delivery channel comprising a plurality of second portion ducts, each second portion duct associated with a respective one of the first portion ducts; and each second portion duct having a second portion intake end afferent to a respective second portion inlet positioned on a lower half of the door and adapted to receive the relatively dry air from the respective first portion outlet and a second portion outlet end adapted to exhaust the relatively dry air into the drum when the door is in the closed position; and each second portion inlet being spaced apart from the respective first portion outlet when the door is in the open position.

* * * * *